United States Patent [19]

Yoshida et al.

[11] 4,414,077

[45] Nov. 8, 1983

[54] METHOD FOR PRODUCTION OF COLORED ALUMINUM ARTICLE

[75] Inventors: Kohichi Yoshida, Shimizu; Teruo Miyashita; Yasuo Oka, both of Fuji; Takashi Kajiyama, Shizuoka, all of Japan

[73] Assignee: Nippon Light Metal Company Limited, Tokyo, Japan

[21] Appl. No.: 246,922

[22] Filed: Mar. 23, 1981

[30] Foreign Application Priority Data

Mar. 26, 1980 [JP] Japan ..... 55/37521

[51] Int. Cl.[3] ..... C25D 11/22

[52] U.S. Cl. ..... 204/35 N; 204/42; 204/DIG. 9

[58] Field of Search ..... 204/35 N, 42, 58, DIG. 9

[56] References Cited

U.S. PATENT DOCUMENTS 4,021,315 5/1977 Yanagida et al. ..... 204/35 N
4,066,816 1/1978 Sheasby et al. ..... 428/336
4,128,460 12/1978 Nishimura et al. ..... 204/35 N
4,226,680 10/1980 Cooke et al. ..... 204/28
4,316,780 2/1982 Yoshida et al. ..... 204/35 N

*Primary Examiner*—G. L. Kaplan
*Assistant Examiner*—William Leader
*Attorney, Agent, or Firm*—William J. Daniel

[57] ABSTRACT

The invention comprises an improved method for producing anodized aluminum articles colored by means of optical interference effects. The method comprises the steps of subjecting an aluminum article that has been anodized by conventional process to a treatment for modifying the pore structure of the anodic film, thereafter subjecting it while connected as anode to an electrolytic treatment for modifying the barrier layer between the oxide and the metal substrate and finally coloring the article while connected as cathode in an electrolyic bath containing one or more dissolved metal salts using DC current on which is superimposed a train of positive current pulses.

18 Claims, 3 Drawing Figures

METHOD FOR PRODUCTION OF COLORED ALUMINUM ARTICLE

BACKGROUND OF THE INVENTION

1. Field of the Invention

This invention relates to an improved method for the production of articles of an aluminum or aluminum alloys having a colored anodic oxide film, and more particularly to a method for the production of colored aluminum or aluminum alloy which comprises subjecting an aluminum article having an anodic oxide film formed in advance thereon by an ordinary method to a treatment for modifying the pores in the anodic oxide film and subsequently to an electrolytic coloring treatment thereby effecting the coloration of the aluminum by means of optical interference.

2. Description of the Prior Art

In recent years, colored aluminum articles are extensively used in vehicles, building materials, exterior articles, etc. The colored aluminum articles adopted for these applications have been required to withstand prolonged exposure tp sunlight and weathering conditions without decolorization or discoloration. A process capable of producing colored aluminum articles having excellent weathereability and color fastness involves the electrodeposition of metal salts in the anodic pores of an aluminum article that has previously been anodised by a conventional method. The electrodeposition is carried out using the previously anodised articles or a number of them connected together electrically as one of the electrodes in an electrolytic bath containing one or more soluble salts of a metal such as nickel, tin or cobalt. Either AC or DC current is applied between this electrode and a suitable counter-electrode.

Previous electrolytic coloring provides color tones which are basically determined by the particular kinds of metal salts contained in the electrolytic bath. Only by varying the electrolytic conditions, these color tones may be changed in depth and shade. In commercial scale operations of previously known methods, the colors obtained were limited to dark shades including gray, bronze and black. This method has been incapable of producing colored aluminum articles in bright colors.

Moreover the previous methods have suffered from the disadvantage that whenever colored aluminum articles of a different hue are desired, there is the need to change the electrode to one containing different metal salts or to include baths of different compositions in the color anodising facility.

Recently, as a measure to remove this disadvantage of the conventional electrolytic coloring method, a method has been developed which, as disclosed in U.S. Pat. No. 4,066,816, Japanese Patent Publication No. 13860/1979 and Japanese Patent Publication No. 23658/1979, enables aluminum articles to a very wide range of bright color tones to be freely obtained in the same electrolytic bath by simply adjusting the duration of electrolytic deposition step.

This method primarily comprises subjecting a previously anodised aluminum article having an anodic oxide film formed thereon in advance to a treatment for the modifying of the anodic oxide film prior to the electrolytic coloring treatment by a metal salt thereby enlarging the volume of at least the bottom of the pores in the film. In the subsequent electrolytic treatment of this modified anodic film the upper surface of the deposits in the pores are at substantially the same distance from the barrier layer which separates the oxide from the aluminum substance and the process parameters are chosen so as to make this distance of the order of the wavelength of visible light. The upper surface of the deposits in the pores and the barrier layer are capable of reflecting light and the anodic film treated in this way is colored as a result of optical interference. By adjusting the parameters of the electrolytic treatment this process can be used to produce anodic films which are colored in bright color tones varying in the sequence of purple, indigo, blue, green, yellow, orange and red depending on the change of the duration of the electrolytic treatment, namely on the change in the thickness of the layer of the electrolytic deposits. The color tones obtainable by this method, therefore, have much more variety than those obtained by the conventional coloring method. Moreover, this method has a great economic advantage that aluminum articles of a wide variety of color tones are produced at will in the electrolytic bath containing one and the same metal salt in a single electrolytic bath of a chosen composition. In this method, however, when applied to aluminum articles of complicated shape difficulties may arise in achieving color uniformity.

To overcome the non-uniformity of color tones imparted to colored aluminum articles by the electrolytic coloring method utilizing interference colors, Japanese Patent Publication No. 128547/1978, for example, discloses a method which comprises forming a barrier-type oxide film as an intermediate treatment between a treatment for the modification of the anodic oxide film in preparation for coloring by optical interference and the electrolytic coloring treatment and thereafter performing an AC electrolytic coloring in an electrolytic bath containing one or more salts.

This method subjects an aluminum article to the barrier-type oxide film modification as an intermediate treatment for the purpose of reinforcing the barrier layer throughout the entire anodic oxide film and, at the same time, allowing a barrier film of an increased thickness to be preferentially formed in the portion of the aluminum article which is more susceptible to the flow of electric current, namely the portion in which coloring would occur more quickly and change in color tone would occur more readily during the electrolytic coloring step. The adjustment of the thickness of the barrier layer therefore improves color uniformity and for a given voltage, electrolyte and electrode configuration, and, it also lowers the rate of coloring thus facilitating color control. However while the additional control that can be achieved by the step of thickening and evening up the thickness of the barrier layer is useful, problems remain when AC current is used in the electrolytic coloring process and some of these can be minimized by using DC current instead.

SUMMARY OF THE INVENTION

The inventors had an interest in the electrolytic coloring method by use of DC, which is relatively easy to control, and conducted an experiment in which an aluminum article having a reinforced barrier layer produced thereon in advance was connected as a cathode in an electrolytic bath containing a metal salt and subjected to a constant-current DC electrolysis with a low current density, and succeeded in attaining a relatively slow, well-controlled change of color tone and consequently in producing an aluminum article of a uniform color. Unlike the AC electrolytic method which inevitably relies on voltage control for adjustment of coloring, this method allows easy control of the current flow and hence the rate of coloring in the electrolytic coloring step. While the use of DC current in the electrolytic coloring step gave excellent control of the coloring rate and hence color control it could give rise to film rupture and subsequent spalling and to cloudiness of the color. After further study the inventors found that these problems could be overcome without impairing the color control by superimposing positive pulses on the DC coloring current.

To be specific, the method of this invention for the production of colored aluminum articles utilizing the phenomenon of optical interference comprises subjecting an aluminum article having an anodic oxide film formed thereon in advance to a treatment for the modification of the pores of the anodic oxide film thereafter subjecting the resultant modified aluminum article, as an anode, to a preliminary electrolytic treatment designed for provisional adjustment or reinforcement of the barrier layer, subsequently placing the aluminum article, now as a cathode, in the electrolytic bath containing the metal salt and subjecting it to electrolytic coloring by using DC current with superimposed positive pulses.

This invention, therefore, provides an improved way of securing color uniformity within batches of aluminum articles, especially when those are extruded sections or other articles of complicated shape and of improving the control of color from batch to batch.

DETAILED DESCRIPTION OF THE INVENTION

Figure 1:
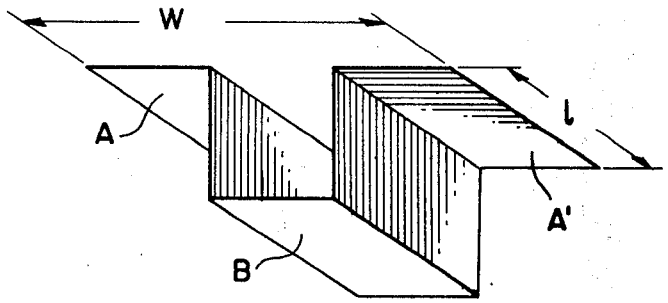
FIG. 1 is a schematic perspective view of a folded plate used in the experiments of Example 1 and Comparative Example 1.

This invention comprises the use of pulsed DC as the final step in the production of colored aluminum articles that have been previously anodised by a conventional process, e.g., in a sulphuric acid electrolyte, with intermediate electrolytic treatments in which at least the bottom of the pores of the anodic film have been enlarged or have become branched and in which the barrier layer on the metal substrate has been modified so as to adjust the differences in its thickness, the coloring of the film being produced by optical interference effects. The pore modifying treatment is accomplished by any known method such as, for example, the method which comprises placing the aluminum article possessed of the anodic oxide film in an aqueous solution containing phosphoric acid or chromic acid as a major component and subjecting it to an electrolytic treatment.

In consequence of this film modifying treatment, at least the bottom portions of the pores in the film, in which the electrolytic depositions of material from the metal salt electrolyte are enlarged or become branched. In the subsequent electrolytic deposition process, the enlargement or branching of these pores permit the material that is to be deposited to be spread out in a thin layer at the bottom of the pores, the thickness of which is controlled by varying the treatment conditions, usually by varying the treatment time. As the thickness of the deposits increases the color of the film so produced which is caused by optical interference, changes through the spectral series from purple to red.

According to this invention, the aluminum article which has undergone the treatment for the modification of the pores of the film as described above is also subjected, as an anode, to a preliminary electrolytic treatment for the modification of the barrier layer before it is subjected to the electrolytic coloring treatment.

The barrier layer modifying bath to be used for this preliminary electrolytic treatment may be the same as the electrolytic bath containing the metal salt which is used in the subsequent electrolytic color deposition treatment. However it need not be the same and it has only to be capable of producing a barrier layer. Examples of the baths which are advantageously used for this purpose include dilute aqueous solution of boric acid, ammonium borate, ammonium tartrate, ammonium phosphate and citric acid, and baths having suitable metal salts dissolved in such aqueous solutions as above.

The anodic current density up to about 3 $A/dm^2$ may be used in the barrier layer modifying. Generally, it is appropriate to carry out this treatment with a current density within the range of from 0.05 to 0.5 $A/dm^2$.

The duration of the preliminary electrolysis is variable with the current density. The sole object of this treatment is to obtain uniform current distribution at all the parts of the aluminum article during the subsequent electrolytic coloring treatment. It is, therefore, desirable to reduce the duration of electrolytic treatment to the minimum at which this object is accomplished. The upper limit is 2 minutes. Generally, the purpose of this preliminary treatment is fulfilled by performing the electrolysis with a current density of 0.05 to 0.5 $A/dm^2$ for a period within the range of from 10 to 60 seconds.

The aluminum article which has undergone the preliminary electrolytic treatment is now subjected, as a cathode, to an electrolytic coloring treatment in the electrolytic bath of metal salt. Examples of the electrolytic baths which are advantageously used for this purpose include aqueous solutions of salts of nickel, cobalt, copper, tin and other metals which have heretofore been used conventionally for electrolytic coloring. The bath should be kept in an acidic state by incorporation of an inorganic acid such as sulfuric acid or boric acid or an organic acid such as tartaric acid or citric acid. It should be noted, however, that the activity of bath should be adjusted in connection with the metal salt contained in it.

Figure 2A:
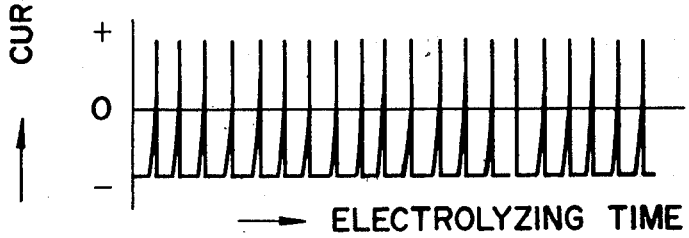
FIGS. 2A and 2B are respectively a diagram showing a pattern of application of pulse voltage in the electrolytic coloring.
Figure 2B:
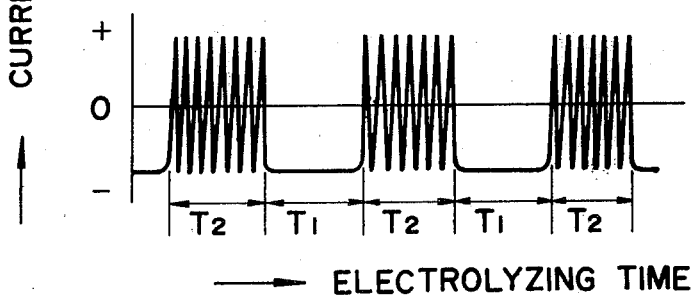

Anodised aluminum article is now made the cathode of the cell containing the coloring electrolyte with counter-electrode being made from an appropriate material such as carbon. DC current on which is superimposed a train of positive pulses as shown in FIG. 2 is passed between the aluminum article and the counter-electrode. FIGS. 2A and 2B show the waveforms of DC current including pulse waves used in the electrolytic coloring process of the present invention, wherein the ordinate represents a current value and the abscissa represents the elapsed electrolyzing time. It is needless to say that according to the present invention other wave form patterns than shown in these Figures can be adopted without deviating from the scope of the invention. The current flowing is controlled at a predetermined level which should give a current density at the surface of the aluminum article not greater than about 1 $A/dm^2$ with the preferred current density lying in the range 0.05 to 0.5 $A/dm^2$. The current density is held at these low levels in order to keep the coloring rate at a low level so as to facilitate color control and matching.

The voltage applied between the aluminum article and the counter electrode is pulsed so that the current flow is reversed periodically with the total period for which anodic current flows to the aluminum article being only a fraction of the time for which cathodic current flows from it to the counter-electrode. For the pulsed current to achieve its effect the peak anodic current should be substantially equal to the maximum cathodic current. The use of current pulses of appropriate frequency and duration in this way prevents the occurrence of spalling and cloudiness of the produced and enables good color matching control to be achieved. Defining the frequency of the pulses as F and the period for which anodic and cathodic currents flow to and from the aluminum article as $T_A$ and $T_C$ respectively, we have found that to obtain the benefits of our invention, F should lie in the range 200 to 2600 pulses per minute and preferably 300 to 1800 pulses per minute while the ratio $T_A/T_C$ should not exceed 0.3 and should preferably lie in the range 0.01 to 0.15.

Experiments have shown that pulse frequency should lie in the range 200 to 2600 cycles per minute, preferably 300 to 1800 cycles per minute and the ratio $T_A/T_C$ should be below 0.3 and preferably in the range 0.01 to 0.15.

The effect of eliminating the spalling and the cloudy appearance is obscured when the frequency of the application of pulse current and/or the $T_A/T_C$ ratio fall off the preferable ranges mentioned above. The progress of the electrolytic coloring is gradually retarded and, consequently, the uniformity of color is lost when as the frequency of pulses and/or the $T_A/T_C$ ratio appreciably exceed their preferable ranges.

As the electrolytic coloring proceeds, the aluminum article assumes a color tone which gradually varies in the sequence of purple, indigo, blue, green, yellow, orange and red. The aluminum article in a desired color can be obtained by discontinuing the electrolytic coloring treatment at the time the color reaches that tone.

After the electrolytic coloring treatment has been completed the aluminum article is rinsed in water. Subsequently, it may be subjected to a sealing treatment by exposure to hot steam or by immersion in hot water or to a coating treatment resorting to electrodeposition or using a clear lacquor.

In producing a colored aluminum article by subjecting an aluminum article which has undergone a treatment for the modification of the pores in the anodic oxide film on the aluminum article in preparation for production of interference colors, to an electrolytic coloring treatment, the method of this invention makes it possible to produce a brightly-colored aluminum article of uniform and stable color tone without entailing either spalling or cloudy appearance, as described above, by subjecting the aluminum article to a preliminary electrolytic treatment to modify the barrier layer thereon and subsequently subjecting the aluminum article, as a cathode, to DC electrolysis using a controlled flow of current superimposed with anodic pulses. Thus, the method of this invention is evaluated highly from a practical point of view.

Now, the present invention will be described below with reference to working examples.

EXAMPLE 1

As an aluminum article, a folded aluminum plate (JIS A1100), which was 200 mm in length and 300 mm in overall width, wherein the portions A, A', and B have the same 100 mm width; and the depth from A and B also 100 mm formed as illustrated in FIG. 1 was immersed in a 15% sulfuric acid bath and subjected to an anodizing treatment by DC current at a current density of 1 A/dm$^2$ to produce an anodic oxide film with an average thickness of 15$\mu$ on the surface.

Then, the aluminum article on which the aforementioned anodic oxide film had been formed, as one electrode, and a carbon electrode were opposed to each other in a 100 g/liter phosphoric acid bath and subjected to electrolysis with AC current at 10 V for three minutes to effect modification of the pores in the anodic oxide film. Subsequently, the aluminum article, now as an anode, and carbon electrode were opposed to each other, with the surface B disposed away from the carbon electrode, in an electrolytic bath containing a nickel salt of the following composition and subjected to a preliminary electrolytic treatment with DC current, with the anodic current density of 0.2 A/dm$^2$, for 30 seconds.

| Bath composition | | |
|---|---|---|
| Nickel sulfate | $NiSO_4.6H_2O$ | 30 g/liter |
| Magnesium sulfate | $MgSO_4.7H_2O$ | 10 g/liter |
| Boric acid | $H_3BO_3$ | 30 g/liter |
| Citric acid | | 10 g/liter |
| Water | | Balance |

Then, the aluminum which had undergone the aforementioned preliminary eletrolytic treatment, now as a cathode, and a carbon electrode were opposed to each other in an electrolytic bath of the same composition as used in the preliminary electrolytic treatment and subjected to electrolytic coloring with DC current superimposed with anodic pulses.

In the electrolytic coloring, the conditions of electrolysis were as follows:

| Conditions of electrolytic coloring | |
|---|---|
| Frequency of pulse application | 300 pulses/minute |
| Plus-minus time ratio ($T_A/T_C$) 0.10 | |
| Cathodic current density | 0.1 A/dm$^2$ |
| Anodic current density (pulse) | 0.1 A/dm$^2$ |
| Bath temperature | 25° C. |

The electrolysis processed without entailing the phenomenon of spalling. The relation between the time of current supply and the color tone of the film as shown in Table 1.

| Duration of current supply | Color tone | |
|---|---|---|
| | Surface A (A') | Surface B |
| $\frac{2}{3}$ minutes | Reddish purple | Same |
| 1 minute | Purplish gray | Same |
| $1\frac{1}{3}$ minutes | Bluish gray | Same |
| $1\frac{1}{2}$ minutes | Grassy green | Same |

COMPARATIVE EXAMPLE 1

The same aluminum article as used in Example 1 was subjected to the same treatment for the formation of the anodic oxide film and to the same treatment for the modification of the pores of the film as involved in Example 1. Then, the resultant aluminum article was subjected to an AC electrolysis in an electrolytic bath of the same composition as used in Example 1 to 15 V, without undergoing the preliminary electrolytic treatment in advance.

After four minutes of the current supply, the aluminum article assumed a dark reddish purple color on the surface A (A') and a light bronze color on the surface B. Thus, the surface A (A') had totally different color tone from that of surface B.

EXAMPLE 2

As an aluminum article, an aluminum plate (JIS A1100 150 mm+150 mm) was subjected to a treatment for the formation of an anodic oxide film and a treatment for the modification of the pores in the film under the same conditions as used in Example 1. In the same coloring electrolytic bath as used in Example 1, the aluminum article, as an anode, was subjected to a preliminary electrolytic treatment using DC current, at an anodic current density of 0.15 A/dm$^2$, for 45 seconds. Subsequently, with the power source reversed and the aluminum article used as a cathode, electrolytic coloring was carried out by supplying DC current superimposed with anodic pulses under the following conditions.

| Conditions for electrolytic coloring | |
|---|---|
| Frequency of pulse application | 600 pulses/minutes |
| Plus-minus time ratio ($T_AT_C$) | 0.10 |
| Cathodic current density | 0.1 A/dm$^2$ |
| Anodic current density (pulse) | 0.1 A/dm$^2$ |
| Bath temperature | 25° C. |

The relation between the duration of the current supply and the color tone is shown in Table 2 (a).

COMPARATIVE EXAMPLE 2

The same aluminum article as used in Example 2 was subjected to a treatment for the formation of an anodic oxide film and a treatment for the modification of the pores of the film under the same conditions as used in Example 1. Then, the resultant aluminum article was subjected to electrolytic coloring with AC of 10 V, 60 cycles in an electrolytic bath of the same composition as used in Example 1 without undergoing a preliminary electrolytic treatment in advance. The results are shown in Table 2 (b).

TABLE 2

| Duration of current supply | (a) Example 2 | (b) Comparative Example 2 |
|---|---|---|
| 1½ minutes | Reddish purple | Dark beige |
| 2 minutes | Purplish gray | Brown |
| 2½ minutes | Bluish gray | Purplish brown (color change in peripheral zone) |
| 3 minutes | Grassy green | Bluish purple (color change in peripheral zone) |

It is seen from Table 2 that, in the aluminum article obtained in Comparative Example 2 by the conventional electrolytic coloring utilizing optical interference, the coloring was obtained with poor uniformity and the color tone changed too quickly to permit easy "color matching" for the production of a desired color tone.

EXAMPLE 3

As an aluminum article, an extruded aluminum piece (JIS A6063 H section; 50 mm×100 mm×12 mm in overall dimension) was subjected to an anodising treatment in a 15% sulfuric acid bath with DC current at a current density of 1 A/dm$^2$ to form an anodic oxide film averaging 20μ in thickness on the surface.

Then, the resultant aluminum article, as one electrode, and a carbon electrode were opposed to each other in a 120 g/liter phosphoric acid bath and subjected to DC electrolysis at 10 V for two minutes to enlarge the film pores.

Thereafter, the aluminum article, as an anode, and a carbon electrode were opposed to each other in an electrolyte containing a nickel salt of the following composition, and DC current was passed, with an anodic current density of 0.15 A/dm$^2$, for 32 seconds to effect preliminary electrolysis.

| Bath composition | | |
|---|---|---|
| Nickel sulfate | $NiSO_4.6H_2O$ | 30 g/liter |
| Ammonium sulfate | $(NH_4)_2SO_4$ | 50 g/liter |
| Boric acid | $H_3BO_3$ | 40 g/liter |
| Water | | Balance |

Then, the aluminum article which had undergone the preliminary electrolytic treatment, as a cathode, and a carbon electrode were opposed to each other in an electrolytic bath of the same composition as used in the preliminary electrolytic treatment, by passage of DC current superimposed with anodic pulses, to effect electrolytic coloring.

| Conditions for electrolytic coloring | |
|---|---|
| Frequency of pulse application | 420 pulses/minute |
| Plus-minus time ratio ($T_AT_C$) | 0.12 |
| Cathodic current density | 0.15 A/dm$^2$ |
| Anodic current density (pulse) | 0.12 A/dm$^2$ |
| Bath temperature | 20° C. |

The electrolysis proceeded without entailing the phenomenon of spalling. The relation between the duration of current supply and the film color tone was as shown in the following Table. At all stages of color tone variation, the aluminum article assumed a color tone clear and free from cloudiness.

TABLE

| Duration of Current Supply | Color Tone |
|---|---|
| 1½ min | Pinkish Purple |
| 2 min | Purplish Grey |
| 2½ min | Bluish Grey |
| 3 min | Light Green |

COMPARATIVE EXAMPLE 3

The same aluminum article as used in Example 3 was subjected to an anodising treatment, a treatment for the modification of the pores in the film and a preliminary electrolytic treatment under the same conditions as involved in Example 3. In the subsequent treatment for electrolytic coloring, the aluminum article was exposed to anodic DC electrolysis under the same electrolytic conditions as used in Example 3 without superimposing the pulse current. In the course of the electrolysis, spalling and rough deposition of metal were observed. Thus, the electrolysis could not be continued any further.

We claim:

1. An improved method for the electrolytic coloring of anodized aluminum by optical interference effects, which comprises subjecting an aluminum article carrying on its surface a porous anodic oxide film including a barrier layer in sequence to (1) an electrolytic treatment for enlarging the volume of the bottom of the pores in the film, (2) a preliminary electrolytic treatment in which said article is connected as an anode to a DC current to adjust the difference in thickness of said barrier layer to obtain more uniform current distribution at all parts of said article during subsequent coloring, and (3) an electrolytic coloring treatment in which the aluminum article is connected as a cathode in an electrolytic bath containing a soluble metal salt and subjected to electrolysis with a negative DC current having superimposed positive pulses to produce a metallic electrodeposition at the enlarged bottom of said pores, wherein the frequency of the pulses is in the range of 200 to 2600 pulses per minute and the ratio (Ta/Tc) between the periods of anodic and cathodic currents, respectively, during the coloring treatment does not exceed 0.3, said coloring treatment being controlled such that the upper surface of said deposition is spaced from said barrier layer a distance in the order of the wave length of visible light, whereby the coloration of said article is determined by optical interference effects.

2. The method according to claim 1, wherein the treatment for enlarging of the pore-structure is effected by an electrolytic treatment with an aqueous solution consisting essentially of phosphoric acid or chromic acid.

3. The method according to claim 1, wherein the adjustment of the barrier layer is effected by an electrolytic treatment in a bath containing one or more metal salts.

4. The method according to claim 3, wherein said electrolytic bath for adjusting said barrier layer contains at least one member selected from the group consisting of nickel, cobalt, copper and tin.

5. The method according to claim 3, wherein said electrolytic bath for adjusting said barrier layer is acidic.

6. The method according to claim 3, wherein the electrolytic for adjusting said barrier layer is obtained by dissolving a metal salt in an aqueous solution of one member selected from the group consisting of boric acid, ammonium borate, ammonium tartrate, ammonium phosphate and citric acid.

7. The method according to claim 3, wherein the anodic current density applied to the article during said adjusting treatment is not more than 3 $A/dm^2$.

8. The method according to claim 7, wherein said anodic current density is within the range of from 0.05 to 0.5 $A/dm^2$.

9. The method according to claim 3, wherein the duration of electrolysis in said electrolytic treatment for adjusting said barrier layer is not more than 2 minutes.

10. The method according to claim 9, in which the duration of the electrolytic treatment is in the range 10 to 60 seconds.

11. The method according to claim 1, in which the metal salts contained in said coloring electrolytic bath are salts of one or more of the group consisting of nickel, cobalt, copper and tin.

12. The method according to claim 11, wherein said coloring electrolytic bath is maintained in an acidic condition by addition of sulfuric acid or boric acid.

13. The method according to claim 11, wherein said coloring electrolytic bath is maintained in an weakly acidic condition by addition of tartaric acid or citric acid.

14. The method according to claim 1, wherein the maximum cathodic current flowing through the aluminum article during said coloring treatment has a current density of not more than 1 $A/dm^2$ over the surface of the aluminum article.

15. The method according to claim 14, wherein the current density is in the range of 0.05 to 0.5 $A/dm^2$.

16. The method accordinng to claim 1, wherein the pulses produce a maximum anodic current flowing through the aluminum article during said coloring treatment which at most equals the maximum current flowing in the opposite direction during the remainder of the cycle.

17. The method according to claim 1, wherein the frequency of the said superimposed current pulses is the range 300 to 1800 pulses per minute.

18. The method according to claim 1 in which the ratio $T_A/T_C$ lies in the range 0.01 to 0.15.

* * * * *

UNITED STATES PATENT AND TRADEMARK OFFICE

CERTIFICATE OF CORRECTION

PATENT NO. : 4,414,077

DATED : November 8, 1983

INVENTOR(S) : Kohichi Yoshida et al

It is certified that error appears in the above-identified patent and that said Letters Patent is hereby corrected as shown below:

In the Claims:

Claim 6, line 2, "electrolytic" should read -- electrolyte --.

Signed and Sealed this

Tenth Day of January 1984

[SEAL]

Attest:

GERALD J. MOSSINGHOFF

Attesting Officer

Commissioner of Patents and Trademarks